United States Patent [19]

Horn et al.

[11] 4,277,948

[45] Jul. 14, 1981

[54] CRYOGENIC COOLER WITH ANNULAR REGENERATOR AND CLEARANCE SEALS

[75] Inventors: Stuart B. Horn, Fairfax; Mark S. Asher, Woodbridge; Howard L. Dunmire, Stafford, all of Va.

[73] Assignee: The United States of America as represented by the Secretary of the Army, Washington, D.C.

[21] Appl. No.: 163,853

[22] Filed: Jun. 27, 1980

[51] Int. Cl.[3] ..... F25B 9/00

[52] U.S. Cl. ..... 62/6

[58] Field of Search ..... 62/6

[56] References Cited

U.S. PATENT DOCUMENTS

| | | | |
|---|---|---|---|
| 3,862,546 | 1/1975 | Daniels | 62/6 |
| 3,902,328 | 9/1975 | Claudet | 62/6 |
| 3,969,907 | 7/1976 | Doody | 62/6 |
| 4,092,833 | 6/1978 | Durenec | 62/6 |
| 4,143,520 | 3/1979 | Zimmerman | 62/6 |
| 4,206,609 | 6/1980 | Durenec | 62/6 |

*Primary Examiner*—Ronald C. Capossela

*Attorney, Agent, or Firm*—Nathan Edelberg; Milton W. Lee; Aubrey J. Dunn

[57] ABSTRACT

A Stirling Cooler with a three stage cold finger. The finger includes a stepped displacer in a stepped cylinder. The cylinder is loosely surrounded by an outer shell, with regenerator material in the space between the outer shell and the cylinder. The displacer-cylinder define three swept expansion spaces each communicating with the regenerator space. Clearance seals exist between the displacer and the cylinder because of small diametrical clearance and long axial length with respect to the diametrical clearance.

3 Claims, 1 Drawing Figure

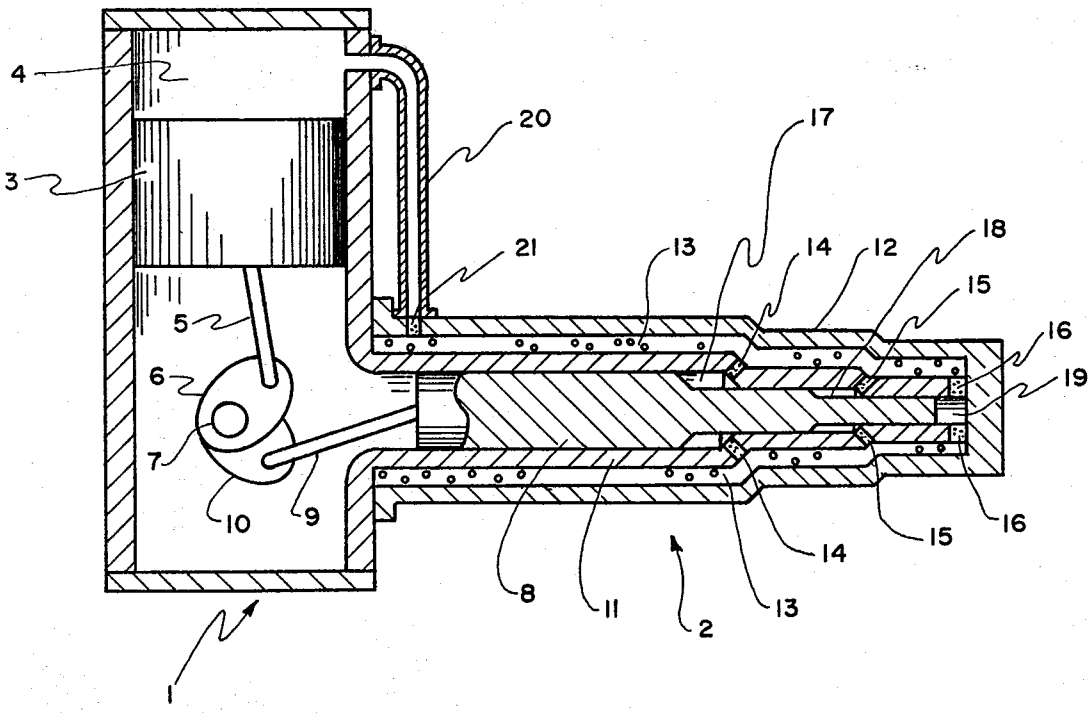
1
2
3
4
5
6
7
8
9
10
11
12
13
13
14
14
15
15
16
16
17
18
19
20
21

CRYOGENIC COOLER WITH ANNULAR REGENERATOR AND CLEARANCE SEALS

The invention described herein may be manufactured, used, and licensed by the U.S. Government for governmental purposes without the payment of any royalties thereon.

BACKGROUND OF THE INVENTION

1. This invention is in the field of Stirling Cycle refrigerators or coolers.

2. There are various applications which require coolers capable of cooling to 10° K. Stirling Cycle coolers for such a temperature usually employ at least two stages of cooling with a regenerator at each stage. Typical of such coolers is U.S. Pat. No. 4,143,520 of Mar. 13, 1979, to Zimmerman. This patent shows a four-stage cooler with a nylon displacer and an epoxy-glass composite cylinder closely surrounding the displacer, but does not show nor describe any discrete regenerator. Lines 61 and 62 of column 2, however, describe how cryogenic fluid picks up heat from the walls of the annular gap in a displacer-cylinder combination. This is a very low efficiency regenerator, a great disadvantage. For best operation of his invention, Zimmerman adjusts the displacer with respect to the cylinder: "After initial cool-down" (column 6, lines 34 and 35). This is another of the disadvantages of the Zimmerman invention. Yet another is that the cylinder, being made of an epoxy-glass composite, is porous to helium and the helium will leak into the vacuum between the cylinder and the metal housing surrounding the cylinder. The instant invention, because of its construction, does not have these disadvantages.

SUMMARY OF THE INVENTION

The invention is a Stirling Cycle cooler with a novel multistage cold finger. This cold finger includes a stepped displacer piston and a stepped cylinder made of a nonmetallic material such as machinable plastic or ceramic and sized to make a clearance seal. Surrounding but spaced from the cylinder is a metallic housing. The space between the cylinder and housing is filled with a thermal regenerative material, and passageways communicate between the space and displacement volumes defined by the displacer piston and the cylinder. Additionally, the displacer piston and cylinder are shaped to reduce turbulence within the displacement volumes and between the volumes in the regenerator space. This invention overcomes all the disadvantages as listed above for Zimmerman by: (1) using a high-efficiency regenerator, (2) using the same material for displacer piston and cylinder so that no adjustment is necessary after cool-down, and (3) using a metal housing to avoid helium loss. Moreover, this cooler, because of its efficient regenerator, is able to cool-down much faster than the Zimmerman device, and is at least an order of magnitude smaller.

BRIEF DESCRIPTION OF THE DRAWING

The single drawing FIGURE is a mostly sectional view of the invention.

DESCRIPTION OF PREFERRED EMBODIMENT OF THE INVENTION

The invention may be best understood when this description if taken in conjunction with the drawing.

Reference numeral 1 generally designates a compressor section of a Stirling Cycle cooler and 2 generally designates the cold finger of this cooler. The compressor section includes a piston 3 operating on a compression volume 4. The piston is moved by connecting rod 5 attached to crank arm 6 on crankshaft. This shaft is turned in the usual manner by an electric motor (not shown) or the equivalent. Cold finger 2 includes a stepped displacer piston 8 attached to connecting rod 9. This rod is attached to crank arm 10 carried by crankshaft 7. The cold finger further includes stepped displacer cylinder or shell 11 around piston 8, outer housing or shell 12 surrounding 11, regenerator material 13 between the shells, and porous plugs or the equivalent 14, 15, and 16 through shell 11. These plugs allow cryogenic fluid in the cooler to pass back and forth between displacement ot expansion spaces 17, 18, and 19 and the regenerator space between the shells. As can be seen, both 8 and 11 are shaped to provide swept displacement spaces, and the bores through 11 for the porous plugs are positioned at the ends of the swept spaces. Pipe 20 connects compressor volume 4 to the regenerator space of the cold finger, and porous plug 21 in shell 12 contains the regenerative material in 12. Piston 8 and cylinder 11 are preferably made of the same nonmetallic material, such as nylon, some other plastic, or a machinable ceramic and are sized to have a clearance seal between them. This type of seal depends upon small clearance between piston and cylinder and long length. An effective seal may be realized with a clearance-to-length ratio of 1:1000. A leak-down time greatly in excess of compressor cycle time is thus provided by this seal. Regenerator material 13 may be any one of various known materials, but the preferred material is small metal balls, which may be easily poured between shells 11 and 12 as the cold finger is assembled. Such balls make an efficient regenerator by having a very large surface area and large thermal mass. Porous plugs 14, 15, 16, and 21 may be made of sintered metal, or metallic wool, or fine screens—merely something to keep the regenerator material in place. It should be understood that the drawing FIGURE is not to scale. Specific dimensions of the displacer may run from 0.5 to 0.2 inches, and from 0.7 to 0.25 inches for the outer shell. Obviously, these dimensions may be scaled upwards or downwards as desired. Although the drawing shows a particular compressor-cold finger configuration, other configurations may be used, such as that shown in U.S. Pat. No. 3,862,546 of Jan. 28, 1975. Further, a split-phase configuration may be used. The instant invention resides in the cold finger part of the cooler, and the particular compressor used therewith is not critical.

We claim:

1. In a Stirling Cycle cryogenic cooler having at least a compressor portion and a cold finger expander portion with a cryogenic fluid in said portions whereby the improvement comprises:

a cold finger expander portion including a displacement piston of a nonmetallic material and having segments of different diameters;

a first shell of said material mainly closely surrounding said piston and having different inside and outside diameters corresponding to the different diameters of said piston whereby different expansion spaces are defined between said piston and said shell;

a second shell surrounding said first shell and having different inside diameters greater than respective outside diameters of said first shell whereby said shells define a regenerator space between them;

bores communicating between said expansion spaces and said regenerator space; and thermal regenerative material in said regenerative space.

2. The cooler as defined in claim 1 wherein the transitions between the different diameters of said piston and said first shell are conical segments.

3. The cooler as defined in claim 1 wherein the respective different diameters of said piston and respective inside diameters of said first shell are sized to form a clearance seal.

* * * * *